United States Patent [19]
Ohgami et al.
[11] Patent Number: 4,470,395
[45] Date of Patent: Sep. 11, 1984

[54] AIR-FUEL RATIO CONTROL SYSTEM

[75] Inventors: Masaaki Ohgami; Yoshiaki Ohara, both of Musashino, Japan

[73] Assignee: Fuji Jukogyo Kabushiki Kaisha, Tokyo, Japan

[21] Appl. No.: 312,602

[22] Filed: Oct. 19, 1981

[30] Foreign Application Priority Data

Oct. 23, 1980 [JP] Japan ..... 55-148930

[51] Int. Cl.³ ..... F02M 7/12

[52] U.S. Cl. ..... 123/440; 123/586; 123/589

[58] Field of Search ..... 123/440, 489, 492, 586, 123/589, 493

[56] References Cited

U.S. PATENT DOCUMENTS

| | | | |
|---|---|---|---|
| 4,089,313 | 5/1978 | Asano et al. | 123/489 |
| 4,119,072 | 10/1978 | Asano | 123/440 |
| 4,137,877 | 2/1979 | Saito | 123/440 |
| 4,143,623 | 3/1979 | Norimatsu et al. | 123/440 |
| 4,144,847 | 3/1979 | Hosaka | 123/440 |
| 4,221,191 | 9/1980 | Asano et al. | 123/492 |

*Primary Examiner*—Andrew M. Dolinar
*Attorney, Agent, or Firm*—Martin A. Farber

[57] ABSTRACT

An air-fuel ratio control system for an internal combustion engine having an emission control system with a three-way catalytic converter for controlling the air-fuel ratio in accordance with the operation of the engine. A throttle sensor for detecting a wide-open throttle operation of the engine and a predetermined voltage supply circuit are provided. A feedback control circuit is provided for controlling the air-fuel ratio to the stoichiometric air-fuel ratio in a normal operating condition. A memorizer circuit memorizes a value corresponding to the control output of the feedback control circuit. A first switch means is actuated by the output of the throttle senor to connect the output of the predetermined voltage supply circuit with the input of the feedback control circuit when acceleration is detected, and to cut off the input of the memorizer circuit for maintaining the stored content thereof. A second switch circuit actuated by the output of the throttle sensor to render the feedback control circuit inoperative as a feedback controller, whereby the air-fuel ratio is controlled by the output of the predetermined voltage supply circuit. After the wide-open throttle operation, the feedback control circuit re-starts with the stored content in the memorizer circuit.

10 Claims, 4 Drawing Figures

AIR-FUEL RATIO CONTROL SYSTEM

BACKGROUND OF THE INVENTION

The present invention relates to a system for controlling the air-fuel ratio for an internal combustion engine emission control system having a three-way catalyst, and more particularly to a system which effectively controls the air-fuel ratio at acceleration of an engine for a vehicle.

Such a system is a feedback control system, in which an $O_2$ sensor is provided to sense the oxygen content of the exhaust gases to generate an electrical signal as an indication of the air-fuel ratio of an air-fuel mixture supplied by a carburetor. The control system comprises a comparator for comparing the output signal of the $O_2$ sensor with a predetermined value, a proportional and integrating circuit connected to the comparator, a driving circuit for producing square wave pulses from the output signal of the proportional and integrating circuit, and an on-off type electromagnetic valve for correcting the air-fuel ratio of the mixture. The comparator operates to judge whether the feedback signal from the $O_2$ sensor is higher or lower than a predetermined reference value corresponding to the stoichiometric air-fuel ratio for producing an error signal and the signal is integrated by the proportional and integrating circuit to produce an integrated output. The integrated output is converted to pulses for actuating the on-off electromagnetic valve to thereby control the air-fuel ratio of the mixture.

In such a control system, the feedback control is not effected during rapid acceleration with a wide-open throttle (WOT) engine operation and a pulse train having a predetermined duty ratio is produced for supplying a rich air-fuel mixture for the purpose of performance of the rapid acceleration. When the acceleration finishes and the throttle valve returns to a part open throttle condition, the feedback control operation becomes effective again. At the moment of re-start of the feedback control operation, the integrating circuit starts to integrate the input signal from the minimum value set in the circuit. Consequently, a longer time than the normal control condition is elapses until the integrated value reaches a value sufficient to reduce the rich air-fuel mixture during the acceleration to a lean air-fuel mixture for controlling the air-fuel ratio. As a result, controlling the air-fuel ratio to the stoichiometric air-fuel ratio is delayed.

SUMMARY OF THE INVENTION

The object of the present invention is to provide an air-fuel ratio control system which may quickly control the air-fuel ratio to the stoichiometric air-fuel ratio without delay after wide-open throttle condition. In the system of the present invention, when the throttle valve is widely opened, the output of the PI control circuit (duty ratio) immediately before the wide-open throttle is memorized, and the air-fuel ratio control starts at the memorized output after the wide-open throttle operation.

According to the present invention, there is provided an air-fuel ratio control system for an internal combustion engine having an induction passage, a carburetor, an electromagnetic valve for correcting the air-fuel ratio of the air-fuel mixture supplied to said carburetor, an $O_2$ sensor for detecting oxygen concentration of exhaust gases, and a feedback control circuit responsive to the output of the $O_2$ sensor for producing a control output signal for driving the electromagnetic valve for correcting the air-fuel ratio; the improvement comprising means for detecting the operation of the engine and for producing an output signal when the throttle valve of the engine is widely opened; memorizing means for memorizing a value corresponding to the control output of the feedback control circuit; voltage apply means for applying a predetermined voltage to the feedback control circuit; first switch means responsive to the output signal of the detecting means to connect output of the voltage apply means with the input of the feedback control circuit and to cut off the input for the memorizing means for maintaining the stored content thereof; and second switch means responsive to the output signal of the detecting means to render the feedback control circuit inoperative as a feedback controller and operative for input voltage from the voltage apply means, whereby the feedback control circuit re-starts with the stored content in the memorizing means after the wide-open throttle operation.

Other objects and features of the present invention will become apparent from the following description of a preferred embodiment with reference to the accompanying drawings.

DETAILED DESCRIPTION OF THE PREFERRED EMBODIMENTS

Figure 1:
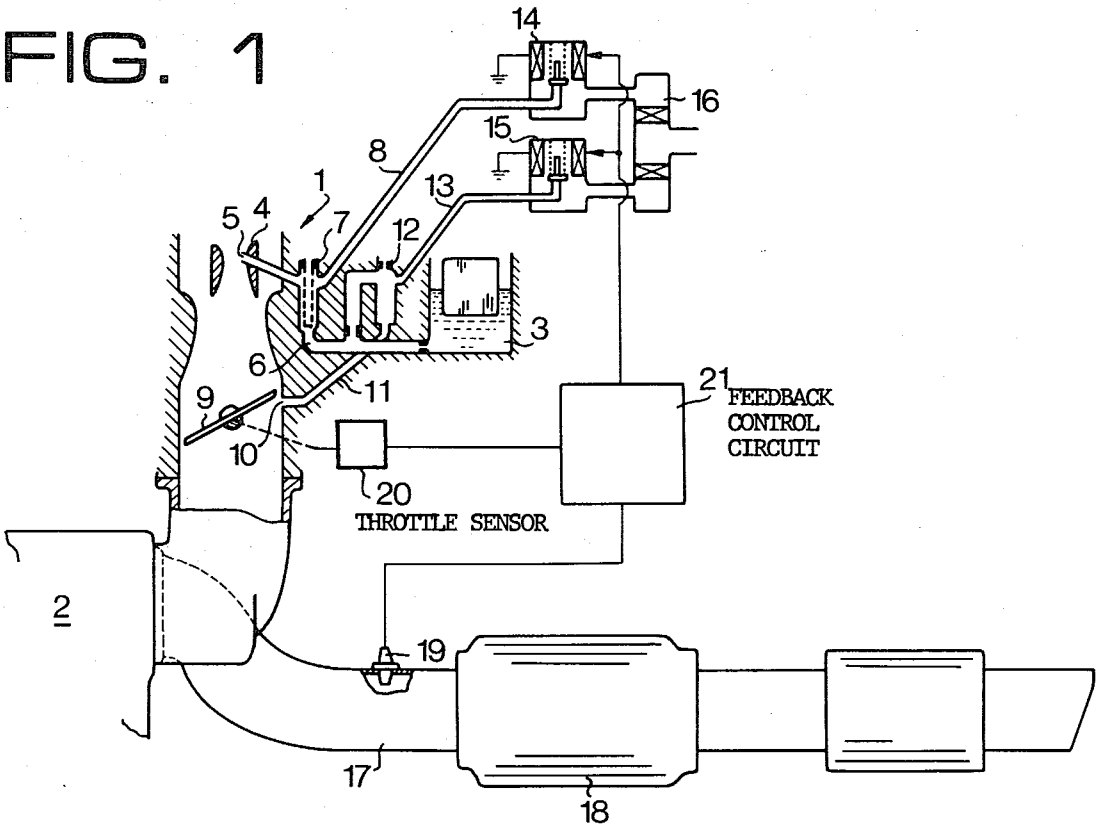
FIG. 1 is a schematic explanatory view of an air-fuel ratio control system.

Referring to FIG. 1 showing schematically the air-fuel ratio control system, a carburetor 1 is provided upstream of an engine 2, a correction air passage 8 communicating with an air-bleed 7 which is provided in a main fuel passage 6 between a float chamber 3 and a nozzle 5 in a venturi 4. Another correction air passage 13 communicates with another air-bleed 12 which is provided in a slow fuel passage 11 which diverges from the main fuel passage 6 and extends to a slow port 10 opening in the vicinity of a throttle valve 9. These correction air passages 8 and 13 communicate with respective electromagnetic valves 14, 15, induction sides of which are communicate with the atmosphere through an air cleaner 16. Further, a three-way catalytic converter 18 is provided in an exhaust pipe 17 at the downstream side of engine, an $O_2$ sensor 19 is provided between the engine 2 and the converter 18 to detect the oxygen concentration of the exhaust gases as the air-fuel ratio of the mixture burned in the cylinders of the engine. A throttle sensor 20 is provided to be operated by a wide open throttle operation.

A feedback control circuit 21 is applied with outputs from these sensors 19 and 20 and produces an output signal to actuate the electromagnetic valves 14, 15 to open and close at a duty ratio varying according to the output signal. The air-fuel ratio is made lean by supplying correction air to the carburetor at a great feed rate and the air-fuel ratio is made rich by reducing the correction air supply.

Figure 2:
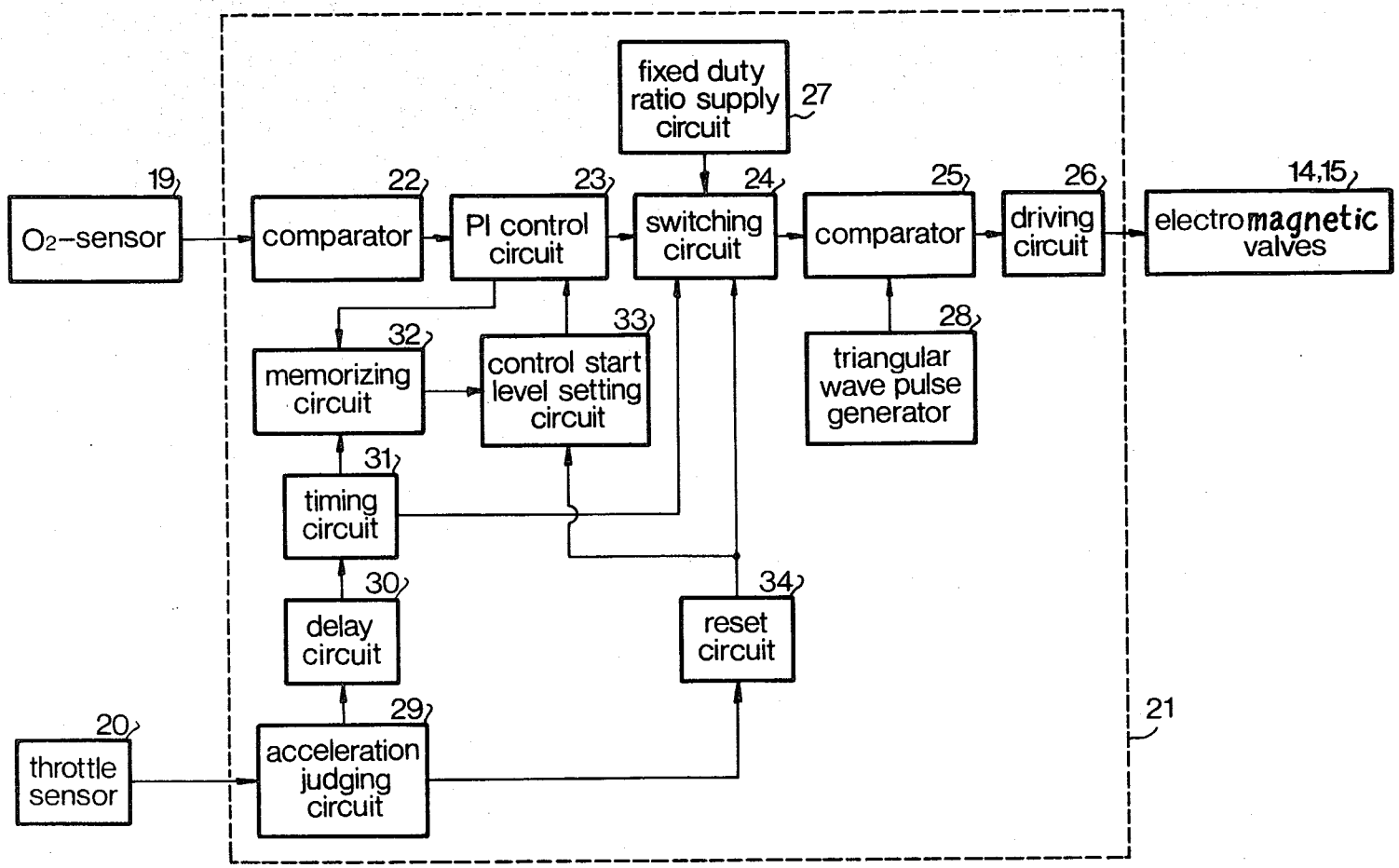
FIG. 2 is a block diagram showing a control circuit of the present invention.

Referring to FIG. 2 which is a block diagram showing the control circuit 21, the output of the $O_2$ sensor 19 is applied to a PI (proportion and integration) control circuit 23 through a comparator 22; the output of the PI control circuit 23 is applied to a comparator 25 through a switching circuit 24; and a triangular wave signal from a triangular wave pulse generator 28 is applied to the comparator 25 for producing square wave pulses. The duty ratio of the square wave pulses varies according to the level of the output of the PI control circuit 23. A driving circuit 26 is applied with the square wave pulses from the comparator 25 to drive the electromagnetic valves 14, 15 at duty ratios of the square wave pulses to control the air-fuel ratio to the stoichiometric value. A fixed duty ratio supply circuit 27 is connected to the switching circuit 24. The detected signal of the throttle sensor 20 is applied to an acceleration judging circuit 29. Outputs of the acceleration judging circuit 29 are connected to a delay circuit 30 and a reset circuit 34. The delay circuit 30 is connected to a memorizing circuit 32 through a timing circuit 31.

When a wide-open throttle is detected by the throttle sensor 20, the judging circuit 29 produces an output signal which is supplied to the memorizing circuit 32 through the delay circuit 30 and the timing circuit 31 with a delay. In acccordance with the signal, the memorizing circuit memorizes the output voltage of the PI control circuit 23. The timing circuit 31 also sends a signal to the switching circuit 24, so that the signal from the PI control circuit 23 is cut off and a signal having a constant duty ratio from the fixed duty ratio supply circuit 27 is applied to the comparator 25. Thus, the electromagnetic valves 14 and 15 are operated at the constant duty ratio to thereby supply a rich air-fuel mixture to the engine.

When the acceleration judging circuit 29 detects completion of the acceleration and produces an output which is applied to the reset circuit 34, the reset circuit 34 sends signals to a control start level setting circuit 33 and to the switching circuit 24 respectively. The switching circuit 24 operates to cut off the signal from the fixed duty ratio supply circuit 27 and to connect the output of the PI control circuit 23 to the comparator 25. The control start level setting circuit 33 sends a signal to the PI control circuit 23 which is dependent on the memorized signal in the memorizing circuit 32. Thus, the feedback control starts at the duty ratio before the wide-open throttle operation.

Figure 3:
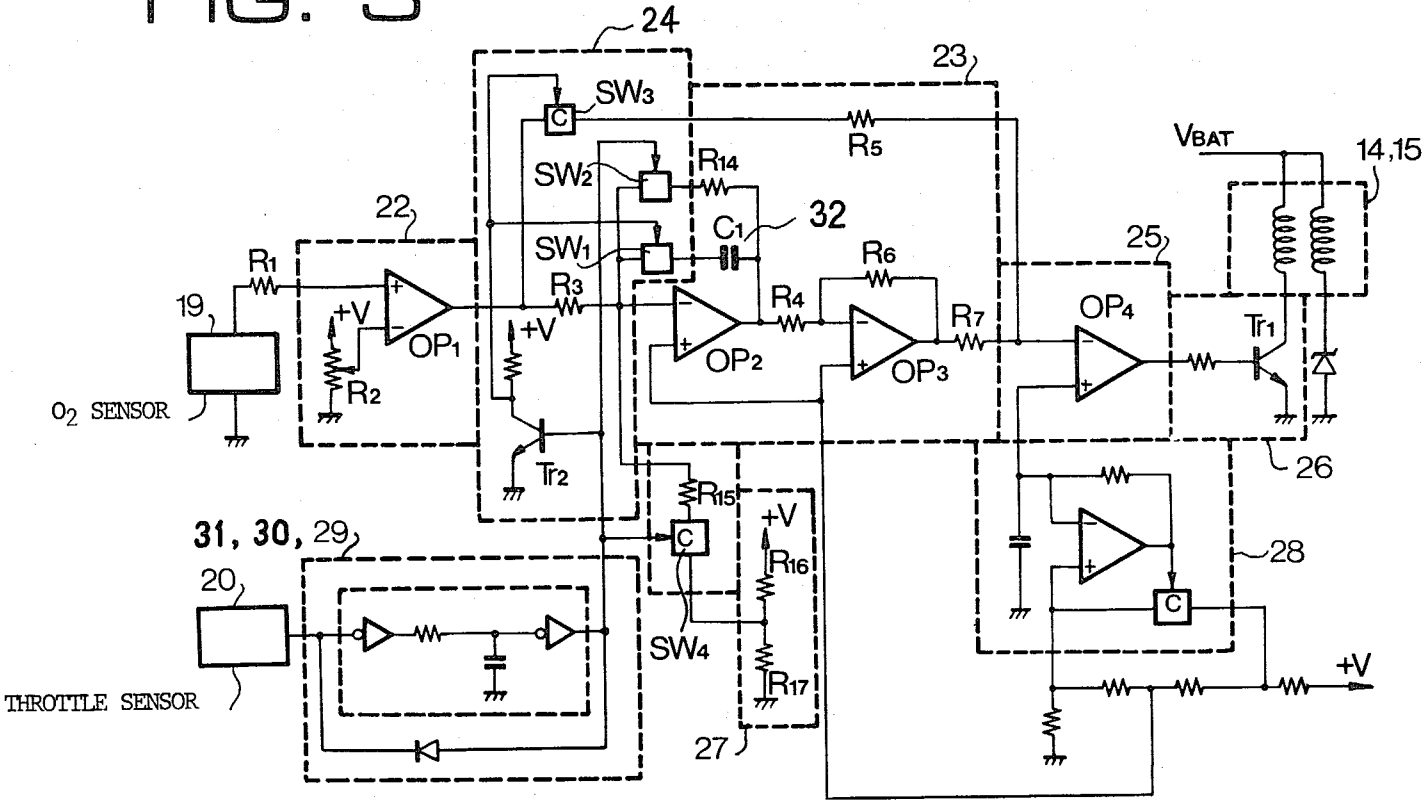
FIG. 3 is an electric circuit embodying the same.

Referring to FIG. 3 showing an example of the system of the present invention, the output of the throttle sensor 20 is connected to the acceleration judging circuit 29 which acts also as the delay circuit 30 and the timing circuit 31. The output of the circuit 29 is connected to control gates of switch circuits $SW_2$, $SW_4$ and to the base of a transistor $Tr_2$. The collector of the transistor $Tr_2$ is connected to control gates of switch circuits $SW_1$ and $SW_3$. The supply voltage V as a constant duty ratio source is divided by resistors $R_{16}$ and $R_{17}$ and applied to an input of the PI control circuit 23 through the switch $SW_4$ and resistor $R_{15}$ when the switch $SW_4$ is on. The PI control circuit 23 comprises operational amplifiers $OP_2$ and $OP_3$, a capacitor $C_1$ and resistors $R_4$, $R_5$, $R_6$, $R_7$ and $R_{14}$. The capacitor $C_1$ acts also as the memorizing element 32. The other circuits are the same as FIG. 2 and designated by the same references.

In operation, the output of the $O_2$ sensor 19 corresponding to the air-fuel ratio of the mixture is applied to an operational amplifier $OP_1$ through a resistor $R_1$ and compared with a standard value set by a variable resistor $R_2$. The output of the operational amplifier $OP_1$ is integrated and amplified by the operational amplifiers $OP_2$ and $OP_3$. The output of the operational amplifier $OP_3$ is compared with a triangular pulses from the triangular wave pulse generating circuit 28 in the comparator 25, which is formed by the operational amplifier $OP_4$, so that the square wave pulses are produced. The square wave pulses operate a transistor $Tr_1$ of the driving circuit 26 for actuating the electromagnetic valves 14 and 15. The range "A" in FIG. 4 shows such a steady condition.

Figure 4:
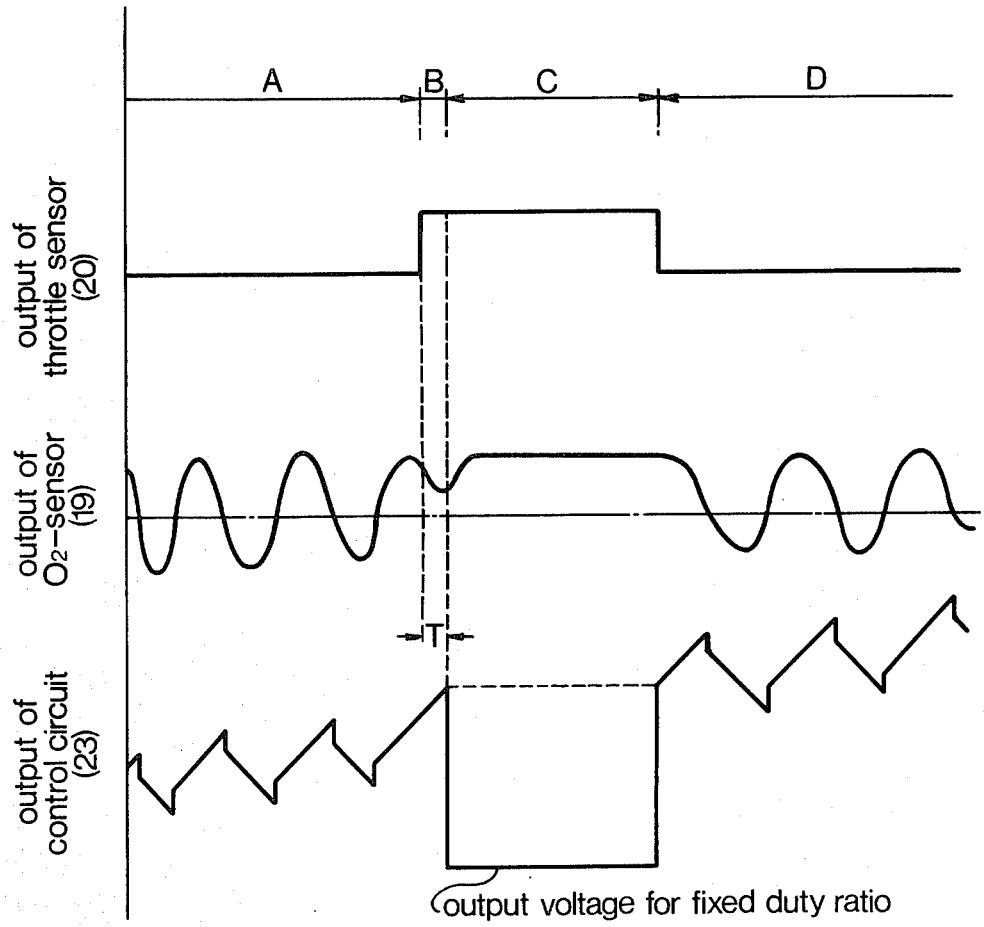
FIG. 4 is a graph showing signals of the system of FIG. 3.

When a wide-open throttle operation is detected by the throttle sensor 20, the acceleration judging circuit 29 produces a high level output with a time delay T (FIG. 4, B). The high level output is applied to the control gates of switch circuits $SW_4$ and $SW_2$ to close these switch circuits turning them on and applied to the base of the transistor $Tr_2$ turn on it, turning off the switch circuits $SW_1$ and $SW_3$. Thus, the operational amplifier $OP_2$ no longer functions as an integrator and the PI control circuit 23 acts as a mere amplifier. At that time, the integrated voltage, which corresponds to the output of the PI control circuit and thus the duty ratio of the pulses from the comparator 25, is stored in the capacitor $C_1$. The voltage V divided by by resistors $R_{16}$ and $R_{17}$ is applied to the operational amplifier $OP_2$ through the switch circuit $SW_4$, so that the output of the PI control circuit 23 (now acting as an amplifier) is kept at a constant voltage. Thus, the duty ratio of the square wave pulses produced from the comparator 25 is fixed to a predetermined value (FIG. 4, C). The duty ratio is selected to a value sufficient to perform a rapid acceleration of the engine.

When the wide-open throttle operation finishes, the output of the acceleration judging circuit 29 changes to a low level. Thus, the switch circuits $SW_2$ and $SW_4$ are opened (turned off) and the switch circuits $SW_1$ and $SW_3$ are closed (turned on). Accordingly, the PI control circuit 23 operates again as the integrator and the output voltage thereof increases from the value according to the voltage stored in the capacitor $C_1$ (FIG. 4D). FIG. 4 shows the relation between the outputs of the PI control circuit 23 before and after the wide-open throttle operation. From the graph, it will be understood that the feedback control re-starts without delay after completion of the wide-open throttle operation.

Thus, in accordance with the present invention, the deviation of the exhaust gas concentration in the wide-open throttle operation can be quickly controlled to the stoichiometric air-fuel ratio.

Although the embodiment shown in FIG. 3 is composed by analog circuit elements, the system of the present invention may be made of a microcomputer system.

What is claimed is:

1. In an air-fuel ratio control system for an internal combustion engine having an induction passage, a carburetor including a throttle valve in said induction passage, an electromagnetic valve for correcting the air-fuel ratio of the air-fuel mixture supplied to said carburetor, and an $O_2$ sensor for detecting oxygen concentration of exhaust gases, and a feedback control circuit responsive to the output of said $O_2$ sensor acting as a feedback controller for producing a control output for driving said electromagnetic valve for correcting the air-fuel ratio to a stoichiometric air-fuel ratio, the improvement comprising detecting means for producing one mode of signals when the throttle valve is widely opened and another mode of signals when the throttle valve is in an other throttle position other than widely opened, delay circuit means responsive to said one mode of signals for producing an output with a delay, memorizing circuit means in said feedback control circuit for storing a value depending on the output of said $O_2$ sensor, a fixed air-fuel ratio supply circuit means for supplying a predetermined voltage to said feedback control circuit, first switch means responsive with said delay to said one mode of signals of said detecting means for cutting off input to said memorizing circuit means for maintaining while the input is cut off the stored value in said memorizing circuit means at the time when the input is cut off and for rendering said feedback control circuit inoperative from acting as the feedback controller, said first switch means responsive with said delay to said one mode of signals of said detecting means for preventing the stored value from acting on the feedback control circuit, second switch means responsive with said delay to said one mode of signals of said detecting means for supplying said predetermined voltage to an input terminal of said feedback control circuit and for rendering said feedback control circuit operative as an amplifier for said predetermined voltage, thereby fixing the air-fuel ratio to a predetermined value, said first and second switch means being inverted by said another mode of signals at said other throttle position after finishing of the throttle valve from being widely opened so that said feedback control circuit is responsive to said stored value maintained in said memorizing circuit means and nonresponsive to the voltage from said fixed air-fuel ratio supply circuit means, and said feedback control circuit acting as the feedback controller re-starts with said stored value from said memorizing circuit means, whereby the deviation of the concentration of the exhaust gases in wide-open throttle operation can be quickly controlled to the stoichiometric air-fuel ratio.

2. The air-fuel ratio control system for an internal combustion engine in accordance with claim 1 wherein said feedback control circuit comprises a proportion and integration circuit.

3. The air-fuel ratio control system for an internal combustion engine in accordance with claim 2 wherein said memorizing circuit means is a capacitor in said integration circuit.

4. The air-fuel ratio control system for an internal combustion engine in accordance with claim 3, wherein said first switch means comprises a first switch in series with said capacitor in a first line connected to an input of said proportion and integrator circuit and a third switch connected in series with a first resistor in a second line connected from an output of said proportion and integrator circuit to said input of said proportion and integration circuit, and a transistor operatively connected between said delay circuit means and control gates of said switches, said second switch means comprises a second switch connected in series with a second resistor in a third line connected in parallel with said first line, and a fourth switch connected between said fixed air-fuel ratio supply circuit means and the input of said proportion and integration circuit, said second and fourth switches have control gates operatively connected to said delay circuit means.

5. The air-fuel ratio control system for an internal combustion engine in accordance with claim 4, wherein said integration circuit includes an operational amplifier having said input of said proportion and integration circuit, said first line is connected across said operational amplifier, the output of said fixed air-fuel ratio supply circuit means is connected to an inverting input of said operational amplifier constituting said input of said proportion and integration circuit during said one mode of signals from said detecting means through said delay circuit means.

6. In an air-fuel ratio control system for an internal combustion engine having an induction passage, a carburetor including a throttle valve in said induction passage, an electromagnetic valve for correcting the air-fuel ratio of the air-fuel mixture supplied to said carburetor, and an $O_2$ sensor for detecting oxygen concentration of exhaust gases, and a feedback control circuit responsive to the output of said $O_2$ sensor acting as a feedback controller for producing a control output for driving said electromagnetic valve for correcting the air-fuel ratio, the improvement comprising detecting means for producing one mode of signals when the throttle valve is widely opened and another mode of signals when the throttle valve is partly opened, memorizing circuit means for storing a value corresponding to the control output of said feedback control circuit, voltage applying means for applying a predetermined voltage to said feedback control circuit, first switch means responsive to said one mode of signals of said detecting means for cutting off input to said memorizing circuit means for maintaining while the input is cut off the stored value in said memorizing circuit means at the time when the input is cut off and for rendering said feedback control circuit inoperative from acting as the feedback controller, second switch means responsive to said one mode of signals of said detecting means for supplying the output of said voltage applying means to an input terminal of said feedback control circuit and for rendering said feedback control circuit operative as an amplifier for said output of said voltage applying means, said first and second switch means being inverted by said another mode of signals at when the throttle valve becomes partly opened after finishing of the throttle valve from being widely opened so that said feedback control circuit is responsive to said stored value maintained in said memorizing circuit means and nonresponsive to the voltage from said voltage applying means, and said feedback control circuit acting as the feedback controller re-starts with said stored value from said memorizing circuit means, said feedback control circuit comprises a proportion and integration circuit, said memorizing circuit means is a capacitor in said integration circuit, said first switch means comprises a first switch in series with said capacitor in a first line connected to an input of said proportion and integrator circuit and a third switch connected in series with a first resistor in a second line connected from an output of said proportion and integrator circuit to said input of said proportion and integration circuit, and a transistor operatively connected between said detecting means and control gates of said switches, and said second switch means comprises a second switch connected in series with a second resistor in a third line connected in parallel with said first line, and a fourth switch connected between said voltage applying means and the input of said proportion and integration circuit, said second and fourth switches have control gates operatively connected to said detecting means.

7. The air-fuel ratio control system for an internal combustion engine in accordance with claim 6, further comprising delay circuit means for delaying responsiveness of said first and second switch means exclusively to said one mode of signals.

8. The air-fuel ratio control system for an internal combustion engine in accordance with claim 7, wherein said first and second switch means act immediately to said another mode of signals.

9. The air-fuel ratio control system for an internal combustion engine in accordance with claim 6, wherein said integration circuit includes an operational amplifier having said input of said proportion and integration circuit, said first line is connected across said operational amplifier.

10. The air-fuel ratio control system for an internal combustion engine in accordance with claim 6, wherein said first and third switches are on and said second and fourth switches are off when the throttle valve is partly opened and said switches are reversed when the throttle valve is widely opened.

* * * * *